US011415312B2

(12) United States Patent
Xia

(10) Patent No.: US 11,415,312 B2
(45) Date of Patent: Aug. 16, 2022

(54) DAZZLE LAMP STRUCTURE OF MICROPHONE SPEAKER

(71) Applicant: Xuefeng Xia, Xuancheng (CN)

(72) Inventor: Xuefeng Xia, Xuancheng (CN)

( * ) Notice: Subject to any disclaimer, the term of this patent is extended or adjusted under 35 U.S.C. 154(b) by 0 days.

(21) Appl. No.: 16/924,608

(22) Filed: Jul. 9, 2020

(65) Prior Publication Data

US 2021/0364160 A1 Nov. 25, 2021

(30) Foreign Application Priority Data

May 13, 2020 (CN) ..... 202020790435.1

(51) Int. Cl.

| | |
|---|---|
| ***F21V 3/02*** | (2006.01) |
| ***H04R 1/08*** | (2006.01) |
| ***H04R 1/04*** | (2006.01) |
| ***F21Y 115/10*** | (2016.01) |
| ***F21V 33/00*** | (2006.01) |
| ***F21V 17/00*** | (2006.01) |
| ***F21V 17/10*** | (2006.01) |
| *F21Y 105/18* | (2016.01) |

(52) U.S. Cl.

CPC ..... *F21V 33/0056* (2013.01); *F21V 3/02* (2013.01); *F21V 17/005* (2013.01); *F21V 17/10* (2013.01); *H04R 1/04* (2013.01); *H04R 1/08* (2013.01); *F21Y 2105/18* (2016.08); *F21Y 2115/10* (2016.08)

(58) Field of Classification Search

CPC ..... F21V 33/0056; F21V 13/02; F21V 17/10; H04R 1/04; H04R 1/08; F21Y 2105/18

See application file for complete search history.

(56) References Cited

U.S. PATENT DOCUMENTS

| | | | | |
|---|---|---|---|---|
| 10,080,072 | B2 * | 9/2018 | Furuya | H04R 1/083 |
| 10,893,366 | B1 * | 1/2021 | Yang | H04R 7/26 |
| 2005/0270782 | A1 * | 12/2005 | Selover | F21V 33/0052 362/362 |
| 2010/0144459 | A1 * | 6/2010 | Sato | A63B 60/54 473/303 |
| 2015/0208152 | A1 * | 7/2015 | Hanna | H04R 1/028 239/289 |
| 2018/0143522 | A1 * | 5/2018 | Harooni | H04R 1/028 |
| 2019/0041050 | A1 * | 2/2019 | Cairns | H05B 45/00 |
| 2020/0236453 | A1 * | 7/2020 | Yoshino | H04R 1/06 |
| 2021/0266428 | A1 * | 8/2021 | Dintner | F21S 8/026 |

* cited by examiner

*Primary Examiner* — Anabel Ton

(74) *Attorney, Agent, or Firm* — Novoclaims Patent Services LLC; Mei Lin Wong

(57) ABSTRACT

A dazzle lamp structure of a microphone speaker comprises a shell, a mounting base, a microphone, a microphone cover, and an LED lamp panel, wherein multiple LED chips are disposed on the LED lamp panel, a white semi-transparent inner lampshade is disposed at the top of the shell and covers the LED lamp panel, the top of the inner lampshade is covered with a dark transparent outer lampshade, and lights emitted by the LED chips sequentially penetrate through the inner lampshade and the outer lampshade to shine out. The dazzle lamp structure can shield strong lights and has a better lighting rendering effect.

10 Claims, 5 Drawing Sheets

DAZZLE LAMP STRUCTURE OF MICROPHONE SPEAKER

BACKGROUND OF THE PRESENT INVENTION

Field of Invention

The invention relates to microphone speakers, in particular to a dazzle lamp structure of a microphone speaker.

Description of Related Arts

Microphone speakers are products that have both a microphone function and a speaker function. To improve the atmosphere created by the products in use, LED dazzle lamps are configured on the shell of many microphone speakers. Such dazzle lamps are typically designed in such a manner that LED chips are arranged in the shell provided with a simple lampshade and are controlled to emit colored lamps to fulfill the purpose of environment rendering. Lights emitted by the LED chips in existing products directly penetrate through the lampshade to shine out, so that the lighting effect of the existing products is glaring. Besides, when multiple LED chips are disposed close to each other, lights diffused by the adjacent LED chips will be mixed, and the lighting effect of each LED chip cannot be reflected, so that the lighting rendering effect is unsatisfying, so user requirements and market requirements cannot be met.

SUMMARY OF THE PRESENT INVENTION

The technical issue to be settled by the invention is to overcome the defects of the prior art by providing a dazzle lamp structure of a microphone speaker, which has a better lighting rendering effect and can meet usage requirements.

The technical solution adopted by the invention to settle the aforesaid technical issue is as follows:

The invention provides a dazzle lamp structure of a microphone speaker. The microphone speaker comprises a shell, wherein a mounting base is formed at the upper end of the shell, a microphone and a microphone cover are fixed on the mounting base, an LED lamp panel is disposed at the top of the shell and is adjacent to the mounting base, multiple LED chips are disposed on the LED lamp panel, a white semi-transparent inner lampshade is disposed at the top of the shell and covers the LED lamp panel, the top of the inner lampshade is covered with a dark transparent outer lampshade, and lights emitted by the LED chips sequentially penetrate through the inner lampshade and the outer lampshade to shine out.

Preferably, the outer lampshade is dark grey.

Preferably, the LED lamp panel is annular and surrounds the mounting base.

Preferably, the multiple LED chips are regularly arranged in the circumferential direction of the LED lamp panel.

Preferably, the inner lampshade and the outer lampshade are both annular and both surround the mounting base.

Preferably, a step ring which bulges upwards is formed on the inner side of the inner lampshade, and the LED lamp panel is located below the step ring.

Preferably, a first flange which protrudes upwards is formed on the edge of the step ring and extends in the circumferential direction of the step ring, a second flange is formed on the inner wall of the outer lampshade and extends in the circumferential direction of the outer lampshade, and the first flange is clamped on the inner side of the second flange and is in close fit with the second flange.

Preferably, a vertical slot is formed in the outer wall of the mounting base, a first insert is formed at the inner end of the step ring, a second insert is formed at the inner end of the outer lampshade, and the first insert and the second insert are sequentially inserted into the vertical slot.

Preferably, two vertical slots are formed in the outer wall of the mounting base and are symmetrically located on two sides of the mounting base, two first inserts are formed at the inner end of the step ring and are in one-to-one correspondence with the vertical slots, and two second inserts are formed at the inner end of the outer lampshade and are in one-to-one correspondence with the vertical slots.

Preferably, the microphone cover covers the mounting base and is screwed on the mounting base, and the lower end of the microphone cover abuts against the outer lampshade.

According to the dazzle lamp structure of the microphone speaker of the invention, the LED lamp panel is disposed at the top of the shell and is covered with the inner lampshade 6, which is a white semi-transparent lampshade and can shield strong lights, so that the eyes are protected against glaring strong lights; on this basis, the inner lampshade of the invention is covered with the outer lampshade which is a dark transparent lampshade, and the outer lampshade in a dark color can absorb one part of dim lights around the LED chips, so that mixing of the dim lights emitted by the adjacent LED chips is avoided, and when the LED chips are turned on, the lighting effect of each LED chip can be clearly seen from the outside; and compared with the prior art, the dazzle lamp structure of the invention can effectively shield strong lights and make the lighting effect of each LED chip clear, thus having a better lighting rendering effect and satisfies user requirements and market requirements.

DETAILED DESCRIPTION OF THE PREFERRED EMBODIMENT

The invention is further expounded below in combination with the accompanying drawing and embodiments.

Figure 1:
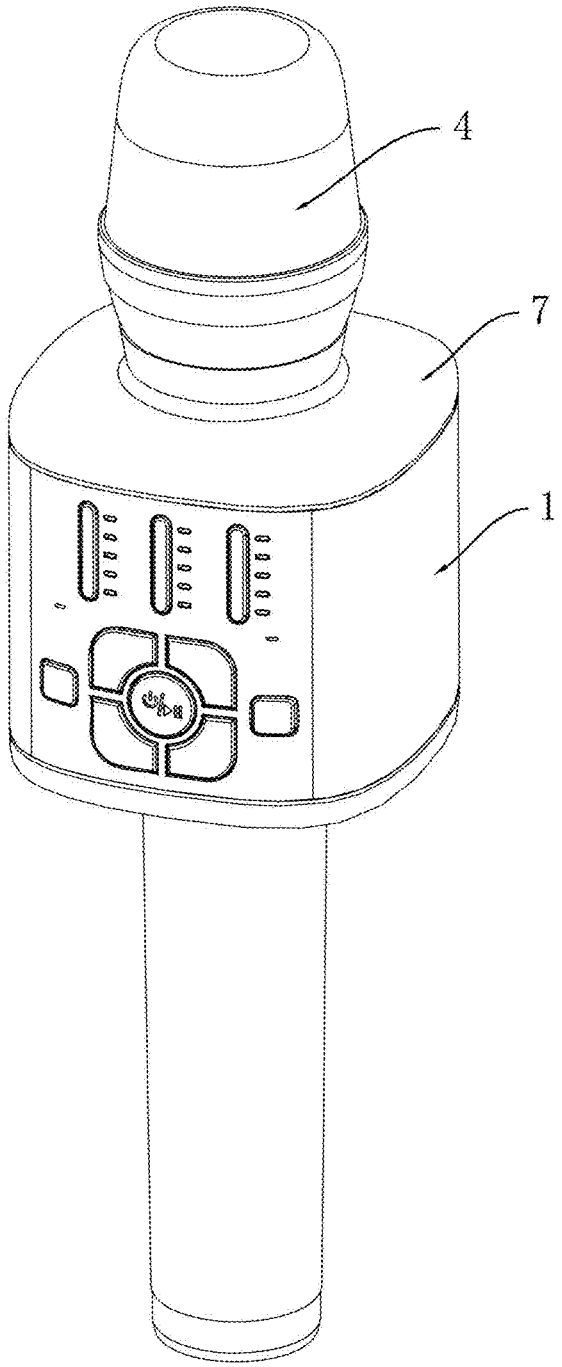
FIG. 1 is a perspective view of a microphone speaker.
Figure 2:
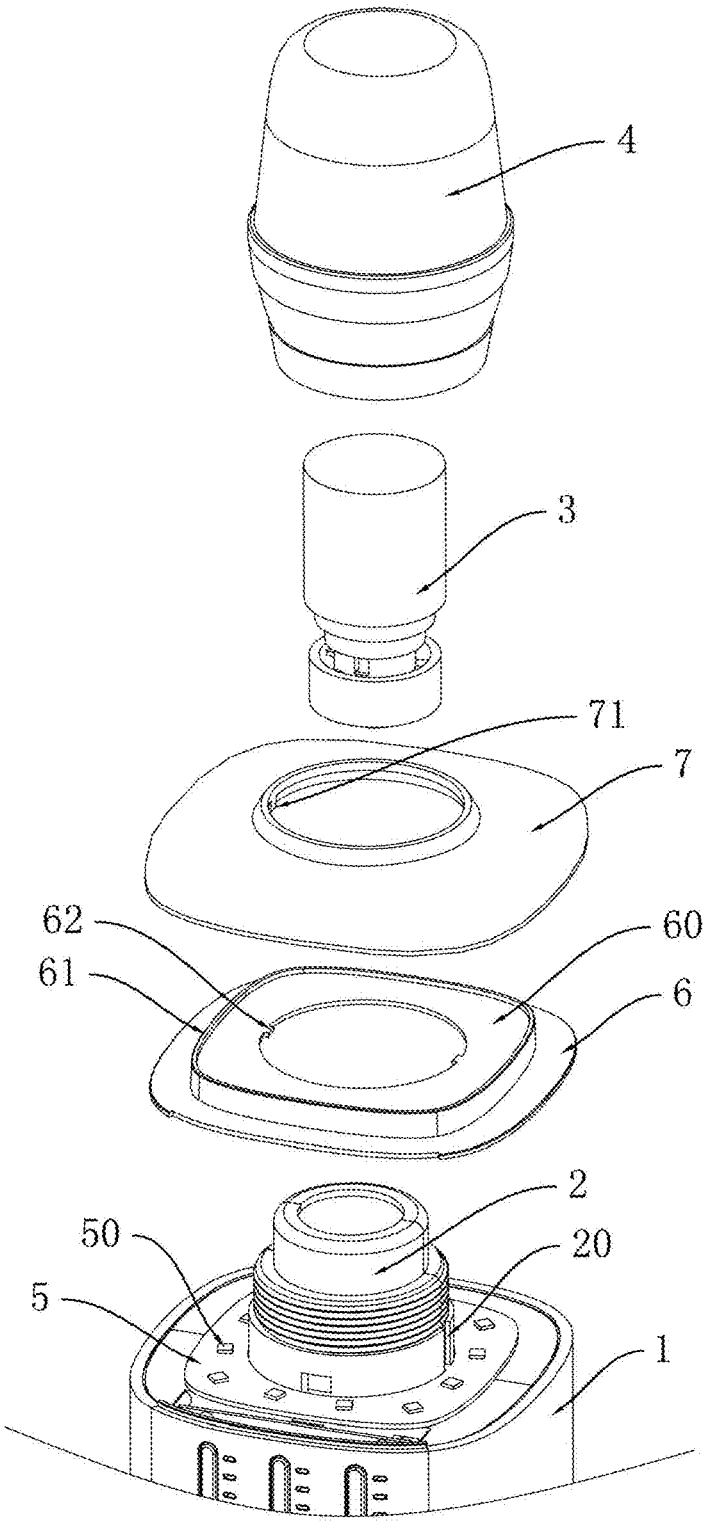
FIG. 2 is a first exploded view of the top structure of the microphone speaker.
Figure 3:
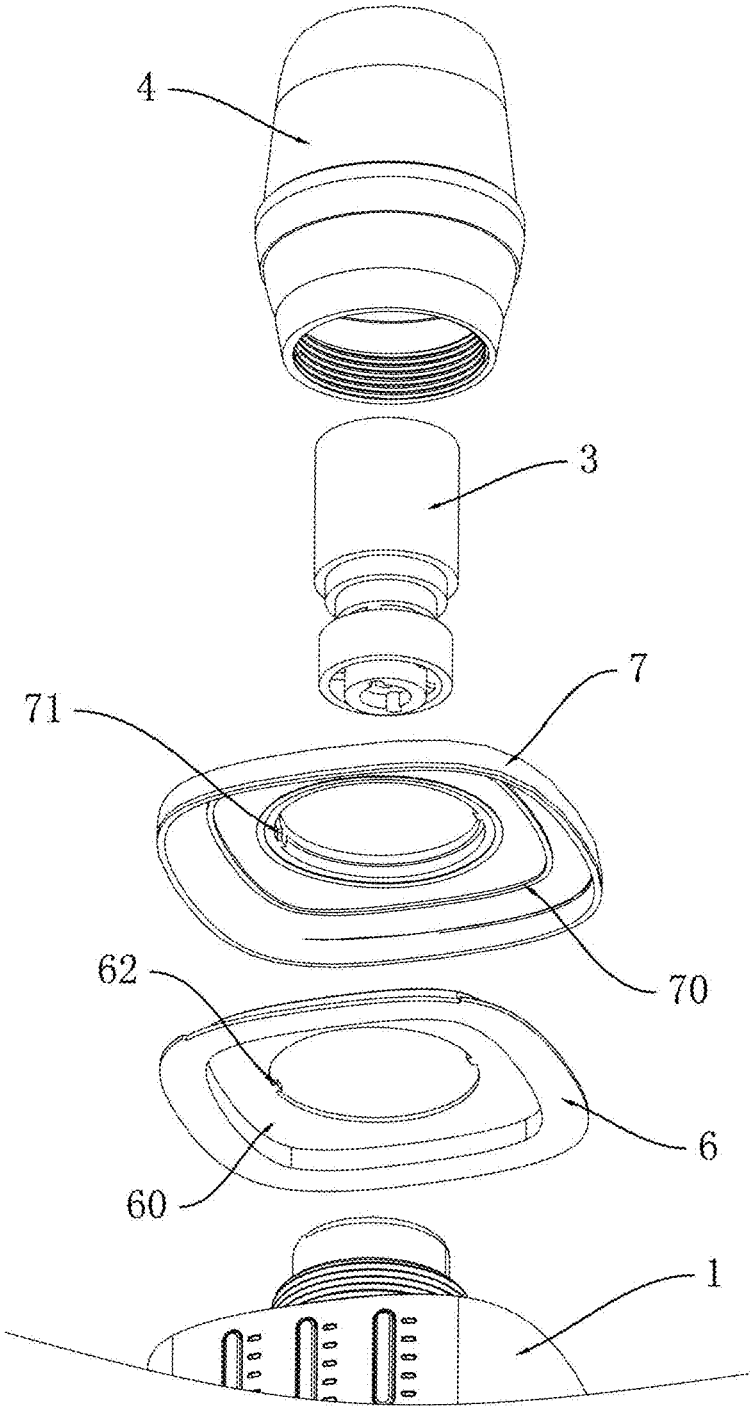
FIG. 3 is a second exploded view of the top structure of the microphone speaker.

The invention discloses a dazzle lamp structure of a microphone speaker. As shown in FIG. 1 to FIG. 3, the microphone speaker comprises a shell 1, wherein a mounting base 2 is formed at the upper end of the shell 1, a microphone 3 and a microphone cover 4 are fixed on the mounting base 2, an LED lamp panel 5 is disposed at the top of the shell 1 and is adjacent to the mounting base 2, multiple LED chips 50 are disposed on the LED lamp panel 5, a white semi-transparent inner lampshade 6 is arranged at the top of the shell 1 and covers the LED lamp panel 5, the top of the inner lampshade 6 is covered with a dark transparent outer lampshade 7, and lights emitted by the LED chips 50 sequentially penetrate through the inner lampshade 6 and the outer lampshade 7 to shine out.

Figure 4:
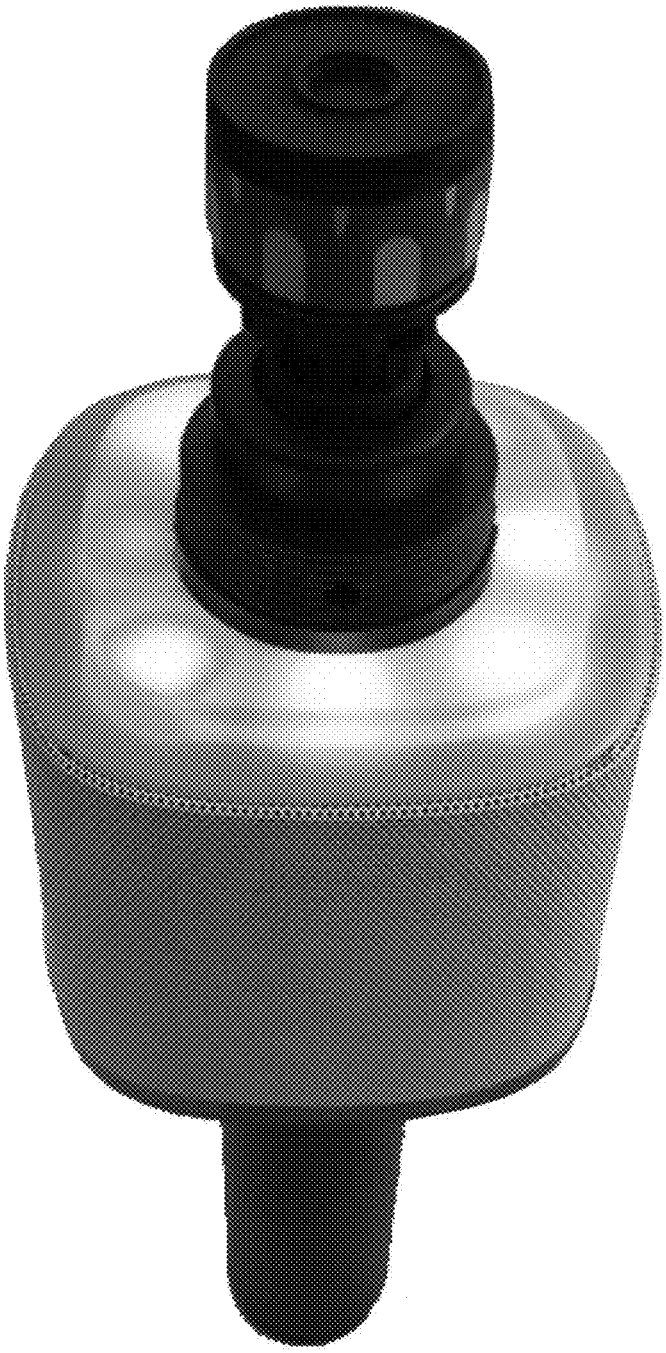
FIG. 4 is an effect picture before an outer lampshade is installed on the microphone speaker.
Figure 5:
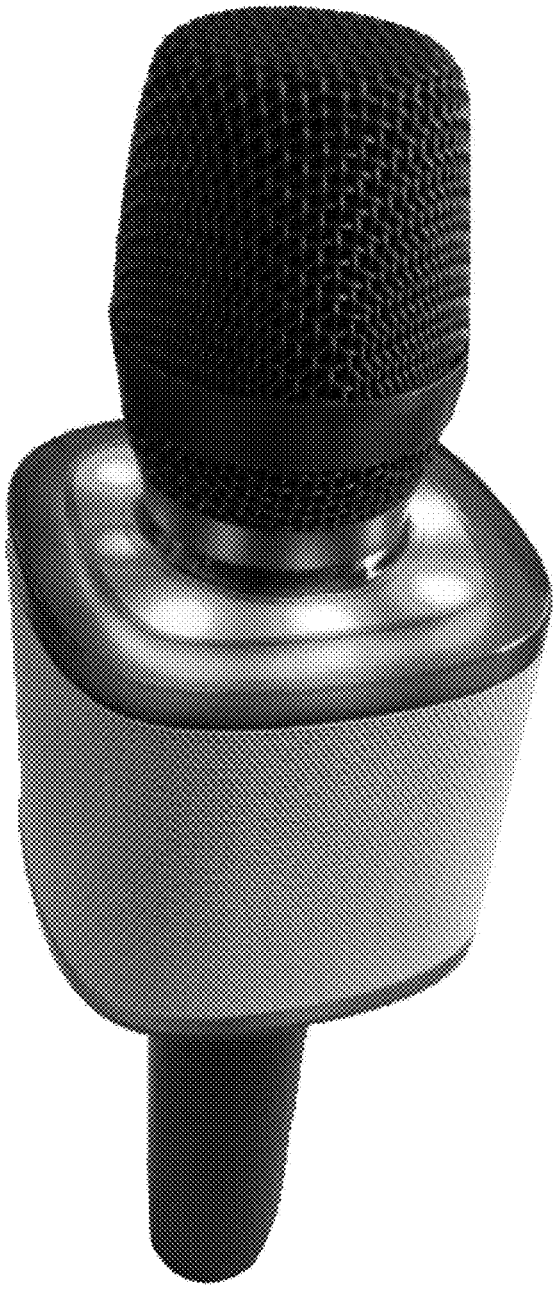
FIG. 5 is an effect picture after the outer lampshade is installed on the microphone speaker.

In this structure, the LED lamp panel 5 is disposed at the top of the shell 1 and is covered with the inner lampshade 6, which is a white semi-transparent lampshade and can shield strong lights, so that the eyes are protected against glaring strong lights, and a lighting effect realized after lights penetrate through the inner lampshade 6 is shown in FIG. 4. On this basis, the inner lampshade 6 of the invention is covered with the outer lampshade 7 which is a dark transparent lampshade, and the outer lampshade 7 in a dark color can absorb one part of dim lights around the LED chips 50, so that mixing of dim lights emitted by the adjacent LED chips 50 is avoided. When the LED chips 50 are turned on, the lighting effect of each LED chip 50 can be clearly seen from the outside, and a lighting effect realized after lights penetrate through the outer lampshade 7 is shown in FIG. 5. As can be seen from the lighting effects illustrated by FIG. 4 and FIG. 5, compared with the prior art, the dazzle lamp structure of the invention can effectively shield strong lights and make the lighting effect of each LED chip 50 clear, thus having a better lighting rendering effect and satisfies user requirements and market requirements.

Preferably, the outer lampshade 7 is dark grey. In actual application, the outer lampshade 7 is not limited to dark gray and can be in other dark colors.

In this embodiment, the LED lamp panel 5 is annular and surrounds the mounting base 2.

Furthermore, the multiple LED chips 50 are regularly arranged in the circumferential direction of the LED lamp panel 5.

To be matched with the LED lamp panel 5, the inner lampshade 6 and the outer lampshade 7 are both annular and both surround the mounting base 2, in this embodiment.

To accommodate the LED lamp panel 5, a step ring 60 which bulges upwards is formed on the inner side of the inner lampshade 6, and the LED lamp panel 5 is located below the step ring 60.

To make the inner lampshade 6 in close fit with the outer lampshade 7, a first flange 61 which protrudes upwards is formed on the edge of the step ring 60 and extends in the circumferential direction of the step ring 60, a second flange 70 is formed on the inner wall of the outer lampshade 7 and extends in the circumferential direction of the outer lampshade 7, and the first flange 61 is clamped on the inner side of the second flange 70 and is in close fit with the second flange 70.

Preferably, a vertical slot 20 is formed in the outer wall of the mounting base 2, a first insert 62 is formed at the inner end of the step ring 60, a second insert 71 is formed at the inner end of the outer lampshade 7, and the first insert 62 and the second insert 71 are sequentially inserted into the vertical slot 20.

Furthermore, two vertical slots 20 are formed in the outer wall of the mounting base 2 and are symmetrically located on two sides of the mounting base 2, two first inserts 62 are formed at the inner end of the step ring 60 and are in one-to-one correspondence with the vertical slots 20, and two second inserts 71 are formed at the inner end of the outer lampshade 7 and are in one-to-one correspondence with the vertical slots 20.

Through the cooperation of the inserts and the slots, the inner lampshade 6 and the outer lampshade 7 can be positioned to be prevented against rotation and dislocation in use, thus improving the performance of the microphone speaker.

In this embodiment, to fix the inner lampshade 6 and the outer lampshade 7, the microphone cover 4 covers the mounting base 2 and is screwed on the mounting base 2, and the lower end of the microphone cover 4 abuts against the outer lampshade 7.

The above embodiments are merely preferred ones of the invention, and are not intended to limit the invention. All modifications, equivalent substitutes or improvements made within the technical scope of the invention should also fall within the protection scope of the invention.

What is claimed is:

1. A dazzle lamp structure of a microphone speaker, the microphone speaker comprising a shell, a mounting base being formed at an upper end of the shell, and a microphone and a microphone cover being fixed on the mounting base, wherein an LED lamp panel is disposed at a top of the shell and is adjacent to the mounting base, multiple LED chips are disposed on the LED lamp panel, a white semi-transparent inner lampshade is disposed at the top of the shell, a dark transparent outer lampshade rests on top of a top of the inner lampshade through a step ring of the inner lampshade and a flange of the outer lampshade, and lights emitted by the LED chips sequentially penetrate through the inner lampshade and the outer lampshade to shine out.

2. The dazzle lamp structure of the microphone speaker according to claim 1, wherein the outer lampshade is dark grey.

3. The dazzle lamp structure of the microphone speaker according to claim 1, wherein the LED lamp panel is annular and surrounds the mounting base.

4. The dazzle lamp structure of the microphone speaker according to claim 3, wherein the multiple LED chips are regularly arranged in a circumferential direction of the LED lamp panel.

5. The dazzle lamp structure of the microphone speaker according to claim 1, wherein the inner lampshade and the outer lampshade are both annular and both surround the mounting base.

6. The dazzle lamp structure of the microphone speaker according to claim 5, wherein the step ring which bulges upwards is formed on an inner side of the inner lampshade, and the LED lamp panel is located below the step ring.

7. The dazzle lamp structure of the microphone speaker according to claim 5, wherein the flange is formed on an inner wall of the outer lampshade and extends in a circumferential direction of the outer lampshade, and another flange which protrudes upwards is formed on an edge of the step ring and extends in a circumferential direction of the step ring, and the another flange is clamped on an inner side of the flange and is in close fit with the flange.

8. The dazzle lamp structure of the microphone speaker according to claim 6, wherein a vertical slot is formed in an outer wall of the mounting base, a first insert is formed at an inner end of the step ring, a second insert is formed at an inner end of the outer lampshade, and the first insert and the second insert are sequentially inserted into the vertical slot.

9. The dazzle lamp structure of the microphone speaker according to claim 8, wherein two vertical slots are formed in the outer wall of the mounting base and are symmetrically located on two sides of the mounting base, two first inserts are formed at the inner end of the step ring and are in one-to-one correspondence with the vertical slots, and two second inserts are formed at the inner end of the outer lampshade and are in one-to-one correspondence with the vertical slots.

10. The dazzle lamp structure of the microphone speaker according to claim 9, wherein the microphone cover covers the mounting base and is screwed on the mounting base, and a lower end of the microphone cover abuts against the outer lampshade.

* * * * *